US005855286A

United States Patent [19]

Zaid

[11] Patent Number: 5,855,286

[45] Date of Patent: Jan. 5, 1999

[54] POLE STORAGE SYSTEM

[76] Inventor: Gene H. Zaid, 213 E. Monroe, Sterling, Kans. 67579

[21] Appl. No.: 7,933

[22] Filed: Jan. 16, 1998

[51] Int. Cl.[6] ..... A47F 5/08

[52] U.S. Cl. ..... 211/87.5; 211/14; 211/181.1

[58] Field of Search ..... 211/85.7, 14, 205, 211/181.1; 248/121, 218.4

[56] References Cited

U.S. PATENT DOCUMENTS

| | | | |
|---|---|---|---|
| D. 39,996 | 5/1909 | Michaelis | 211/181.1 X |
| 1,043,622 | 11/1912 | Miles | 211/181.1 X |
| 1,797,077 | 3/1931 | Dew et al. | 248/121 |
| 2,173,024 | 9/1939 | Park | 248/121 X |
| 5,651,521 | 7/1997 | Aberg | 248/218.4 |

*Primary Examiner*—Ramon O. Ramirez
*Attorney, Agent, or Firm*—Hovey, Williams, Timmons & Collins

[57] ABSTRACT

A pole storage system includes a support stand supporting an upright pole with a plurality of equipment storage and support devices coupled with the pole. In preferred forms, the devices are configured for conveniently supporting and storing athletic equipment such as balls and bats.

16 Claims, 2 Drawing Sheets

POLE STORAGE SYSTEM

BACKGROUND OF THE INVENTION

1. Field of the Invention

The present invention relates to the field of equipment support and storage systems. In particular, the invention is concerned with a pole storage system including a support stand supporting an upright pole with a plurality of equipment storage and support devices coupled with the pole. In preferred forms, the devices are configured for conveniently supporting and storing athletic equipment such as balls and bats.

2. Description of the Prior Art

Convenient and economical storage of athletic equipment has been a problem in the prior art. Typically, athletic equipment such as balls, bats and racquets has been stored in cabinets or large mesh bags. Cabinets are not always available and bag storage can be inconvenient for removing selected pieces of equipment.

SUMMARY OF THE INVENTION

The present invention solves the prior art problems discussed above and provides a distinct advance in the state of the art. More particularly, the pole storage apparatus hereof provides a convenient and economical way to store athletic equipment.

The preferred equipment storage apparatus includes a support pole supported in upright orientation by a support stand with a plurality of equipment storage and support devices coupled with the pole. A preferred mounting bracket for coupling a device with the pole includes a hook member extending from the device for hooking the pole on the side thereof opposite the device. The mounting bracket further includes a mounting arm positioned below the hook member having a bail configured for straddling the pole with the bight thereof engaging the pole on the same side as the device and with the bail legs extending along opposed sides of the pole away from the device side of the pole. The pair of spaced, side-by-side connecting rods interconnect the device and the respective bail legs. Other preferred aspects of the present invention age disclosed herein.

DETAILED DESCRIPTION OF THE PREFERRED EMBODIMENT

Figures 1, 3:
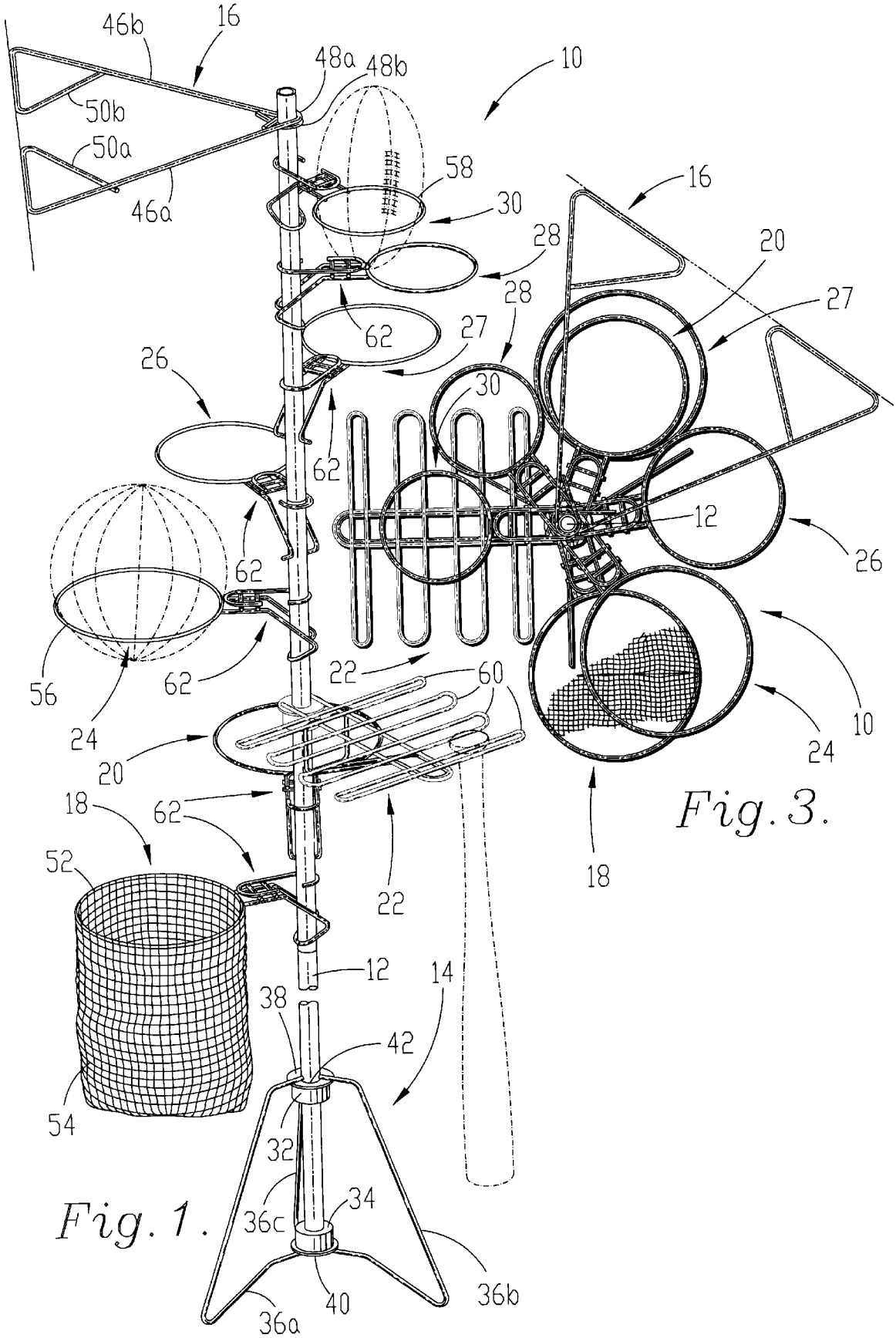
FIG. 1 is a top front pictorial view of the preferred equipment storage apparatus in accordance with, the present invention.
FIG. 3 is a top plan view of the apparatus of FIG. 1.

FIG. 1 illustrates preferred equipment storage apparatus 10 in accordance with the present invention. Apparatus 10 includes support pole 12, support stand 14, stabilizer 16 and equipment storage and support devices 18, 20, 22, 24, 26, 27, 28 and 30.

Support pole 12 presents a tubular configuration and is preferably composed of PVC pipe but could also be composed of metal pipe or wood among other materials. It will also be appreciated that pole 12 could be configured in a plurality of shorter sections joined by conventional pipe couplings which would enable more convenient shipping.

Support stand 14 includes upper collar 32, lower collar 34 and three support legs 36 individually designated as legs 36*a*, 36*b* and 36*c* formed as illustrated from 18-gage bent rod or wire. The upper ends of support legs 36 are welded to flange 38 of upper collar 32 and equally spaced therearound. Similarly, the lower ends of support legs 36 are equally spaced about and welded to flange 40 of lower collar 34. Pole-receiving hole 42 is defined axially through upper collar 32 and sized for slidably receiving support pole 12 therethrough. Pole-receiving hole 44 is defined axially in lower collar 34 and is sized for receiving pole 12 therein. Hole 44, however, does not extend through lower collar 34 and thereby supports the lower end of pole 12 as illustrated in FIG. 1. Legs 36*a–c* form a tripod support and cooperate with collars 32 and 34 to support pole 12 in an upright orientation.

Stabilizer 16 includes stabilizer arms 46*a* and 46*b* each formed of 18-gage bent rod or wire to present the configurations illustrated in FIGS. 1–3 and 6. Stabilizer arms 46*a,b* present respective wire loops 48*a,b* at one end thereof sized for receiving pole 12 therethrough. Loop 48*a* is positioned atop loop 48*b*, axially aligned therewith and welded thereto. Stabilizer arms 46*a,b* extend and diverge from loops 48*a,b* with the distal ends thereof formed into respective, triangle-shaped braces 50*a,b*.

Equipment storage and support devices 18–30 present various configurations for storing and supporting a variety of different types of athletic equipment including balls of various sizes, bats, and racquets. For example, device 18 includes wire-formed hoop 52 with mesh bag 54 suspended therefrom for holding various small items such as baseballs, gloves, golf balls and the like.

Devices 20 and 24–30 present hoops of various diameters for supporting and storing a variety of differently sized balls. For example, hoop 56 of device 24 is sized to hold a basketball illustrated in phantom lines and hoop 58 of device 30 is sized to hold a football shown in phantom lines. Device 22 is also formed of bent rod or wire and is configured to present a plurality of side-by-side grills, 60 spaced to support a baseball bat therebetween as shown in phantom lines.

Apparatus 10 also includes a plurality of mounting brackets 62 for coupling devices 18–20 and 24–30 with pole 12. Each mounting bracket 62 is preferably formed of 18-gage bent rod or wire, extends from a respective device and includes hook member 64 and mounting arm 66. Integral mounting arm 66 includes bail 68 presenting bight 70 and bail legs 72*a* and 72*b* and further includes spaced, side-by-side connecting rails 74*a* and 74*b*.

As best viewed in FIG. 5, rails 74*a,b* are positioned below hook member 64, extend from device 20, for example, and then angle downwardly integrally connecting with the distal ends of bail legs 72*a,b* respectively. Spaced connecting rods 76*a* and 76*b* are welded transversely across rails 74*a,b* adjacent device 20. Hook member 64 is welded to connecting rods 76*a,b* and extends away from device 20.

The configuration of mounting bracket 62 is such that hook member 64 hooks pole 12 on the side thereof opposite device 20 while bight 70 engages pole 12 on the same side thereof as device 20. Bail legs 72*a,b* extend along opposed sides of pole 12 toward the opposite side thereof where they connect to respective connecting rods 76*a,b*. This configures mounting bracket 62 for cantilevered support of device 20.

Figures 2, 4, 5, 6:
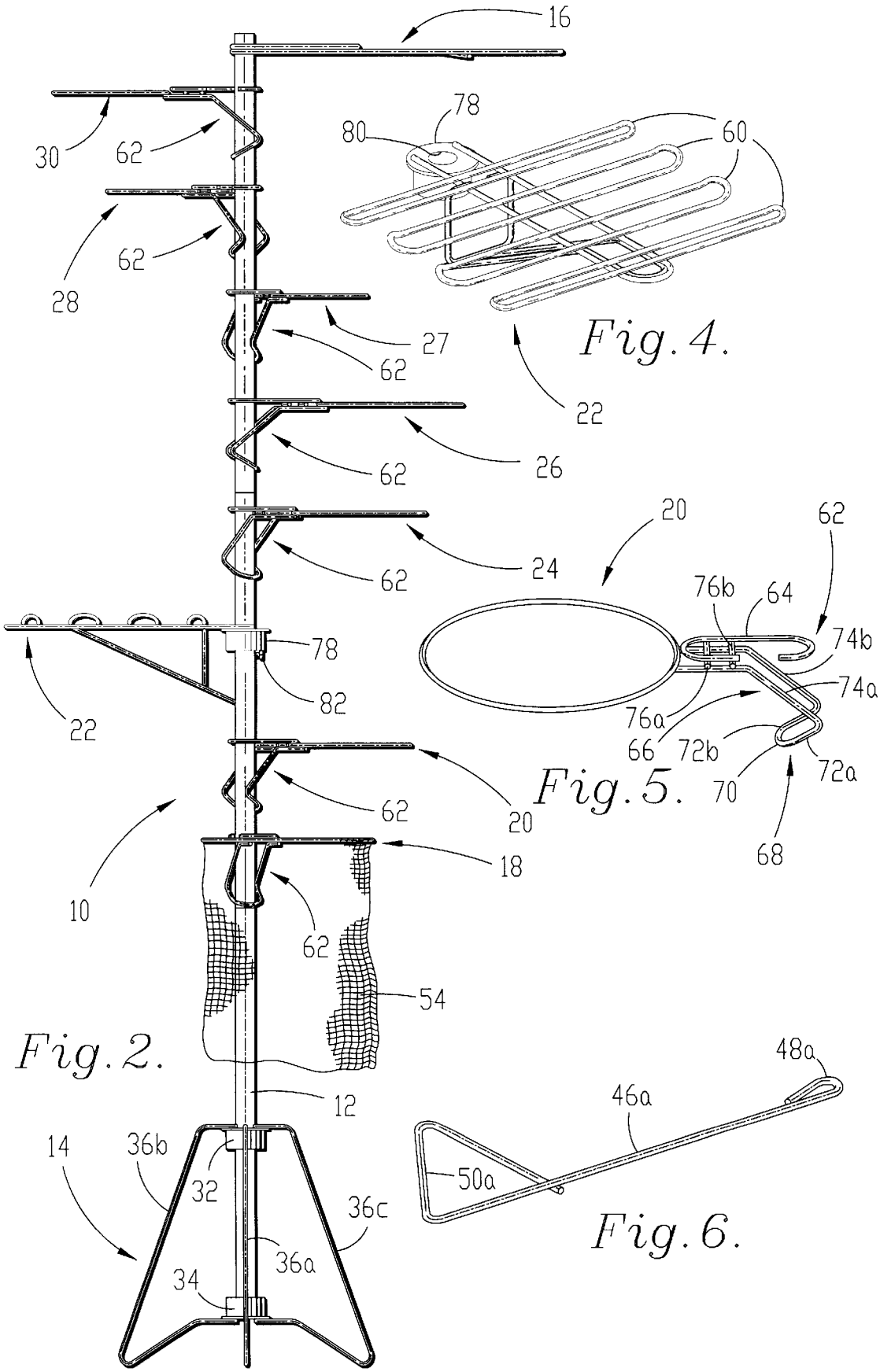
FIG. 2 is a rear elevational view of the apparatus of FIG. 1.
FIG. 4 is a pictorial view of the bat and racquet storage and support device of FIG. 1.
FIG. 5 is a pictorial view of the ball storage and support device of FIG. 1.
FIG. 6 is a top plan view of a stabilizer arm of FIG. 1.

As illustrated in FIG. 4, mounting collar 78 is an alternative for coupling a device with pole 12 and is preferred for coupling device 22 (used for bats and racquets). Collar 78 includes axially aligned hole 80 sized for slidably receiving pole 12 therethrough in order to position collar 78 at a selected location. Set screw 82 is threadably coupled with collar 78 and can be tightened against pole 12 for holding collar 78 and the attached device, such as device 22, in the selected location on pole 12.

To assemble apparatus 10, support stand 14 is placed on a support surface adjacent a wall. The lower end of pole 12 is inserted through upper collar 20 and into lower collar 34. This positions and supports pole 12 in an upright orientation.

Next, device 22 is coupled by slipping mounting collar 78 over the upper end of pole 12 through hole 80. Collar 78 then positioned at the desired location and set screw 82 tightened.

Stabilizer 16 is attached by receiving the upper end of pole 12 through loops 48*a,b* and braces 50*a,b* positioned against the adjacent wall illustrated by the dashed lines in FIGS. 1 and 3. Toggle bolts or the like can then be used to secure braces 50*a,b* to the wall. The wall and stabilizer arms 46*a,b* present a triangular configuration with pole 12 at the vertex thereof opposite the wall. This securely braces pole 12 to prevent inadvertent tipping of apparatus 10.

Finally, the remaining devices 18–20 and 24–30 are coupled with pole 12 at a selected location and orientation. This is accomplished by tipping a given device upwardly and positioning hook member 64 about pole 12. The device is then lowered until bight 70 engages pole 12. Mounting bracket 62 is configured to present the attached device level with the surface on which support stand 14 rests. It is preferable to orient devices 20–30 about the periphery of pole 12 in order to maintain a general level of balance. It will now be appreciated that apparatus 10 presents a particularly convenient and economical way to store equipment such as athletic equipment.

Those skilled in the art will also appreciate that the present invention encompasses many variations in the preferred embodiment described herein. For example, devices 18–30 can be configured or used as desired for supporting and storing a wide variety of items in addition to athletic equipment.

Having thus described the preferred embodiment of the present invention, the following is claimed as new and desired to be secured by Letters Patent:

1. An equipment storage apparatus comprising:

a support pole;

a support stand coupled with and supporting said pole in an upright orientation;

a plurality of equipment storage and support devices; and couplers configured to connect said devices with said pole at selected locations along the length of said pole, said couplers including a mounting bracket having a hook member extending from a device and configured for hooking said pole on the side thereof opposite said device, and a mounting arm attached to said hook positioned below said hook member and extending downwardly therefrom to engage said pole.

2. The apparatus as set forth in claim 1, said coupler including a collar connected with one of said devices and having a central opening sized for receiving said pole therethrough and for sliding along said pole to a selected location and further including a set screw threadably coupled with said collar and positioned for engaging said pole and holding said collar in a selected location.

3. The apparatus as set forth in claim 1, further including a stabilizer configured for connecting said pole to an adjacent wall.

4. The apparatus as set forth in claim 3, said stabilizer being formed of bent rod forming a loop for receiving said pole therethrough and forming a pair of outwardly extending, diverging stabilizer arms including distal ends, said distal ends configured to couple with the wall.

5. The apparatus as set forth in claim 1, said devices being configured for storing and supporting equipment selected from the group consisting of basketballs, footballs, soccer balls, baseballs, bats, shoes, gloves, caps and racquets.

6. The apparatus as set forth in claim 1, said devices including a bag.

7. The apparatus as set forth in claim 1, said devices being formed of bent rod.

8. The apparatus as set forth in claim 1, said coupler being formed of bent rod.

9. The apparatus as set forth in claim 1, said coupler being formed of wire.

10. The apparatus as set forth in claim 1, said devices being formed of wire.

11. The apparatus as set forth in claim 1, said mounting arm including a bail configured for straddling said pole.

12. The apparatus as set forth in claim 1, said bail and connecting rods being integrally formed of bent rod.

13. The apparatus as set forth in claim 11, said bail including a bight configured to engage said pole on the same side as said device.

14. The apparatus as set forth in claim 13, said bight further including legs extending along opposed sides of said pole away from said same side.

15. The apparatus as set forth in claim 14, said mounting arm further including a pair of spaced, side-by-side connecting rods interconnecting said device and said respective bail legs.

16. The apparatus as set forth in claim 15, said bail and connecting rods being formed of wire.

* * * * *